United States Patent [19]

Guthrie et al.

[11] 4,280,284

[45] Jul. 28, 1981

[54] CLOSED CONDITIONING SYSTEM FOR PEELER LOGS

[75] Inventors: Elmer F. Guthrie, Bellevue; Lennart A. Lundberg, Seattle, both of Wash.

[73] Assignee: A. H. Lundberg Associates, Inc., Mercer Island, Wash.

[21] Appl. No.: 146,444

[22] Filed: May 5, 1980

[51] Int. Cl.[3] ..... F26B 19/00

[52] U.S. Cl. ..... 34/60; 34/13.8

[58] Field of Search ..... 34/9.5, 13.4, 13.8, 34/60, 61, 78

[56] References Cited

U.S. PATENT DOCUMENTS

| | | | |
|---|---|---|---|
| 3,448,530 | 6/1969 | Mortensen | 34/13.8 |
| 3,757,428 | 9/1973 | Runciman | 34/13.8 |

*Primary Examiner*—John J. Camby

*Attorney, Agent, or Firm*—Cole, Jensen & Puntigam

[57] ABSTRACT

Closed water and steam conditioning system for peeler logs in which steam from the boiler house is supplied to an evaporator and clean condensate returned to the boiler. Steam from the evaporator is directed to conditioning tunnels for the peeler logs. Dirty condensate from the conditioning tunnels is delivered to a sump area in which the dirty condensate is screened and at least part of which is directed to shower heads in the conditioning tunnels. The remaining dirty condensate is then directed to the evaporator where steam is generated therefrom. Caustic soda is added to the acidic dirty condensate to maintain a basic pH.

8 Claims, 2 Drawing Figures

CLOSED CONDITIONING SYSTEM FOR PEELER LOGS

BACKGROUND OF THE INVENTION

The invention relates generally to the art of conditioning peeler logs for the plywood industry and more particularly to a closed water and steam conditioning system.

As those skilled in the art are aware, the plywood industry found early in its inception that the handling of large peeler blocks or logs could most easily be accomplished by flotation in log ponds. While in the ponds, the wood remained wet and resulted in satisfactory peeling of the logs into veneer. In order to thaw frozen logs some large vats were heated with steam. Even in warmer weather heating the vats, and hence the peeler blocks, was found to further improve the peeling operation.

As large diameter peeler logs became scarce, the industry turned to the smaller logs. A different handling problem was presented and thus forklifts and log handling machines replaced ponds and vats as new small log veneer plants were built. In order to thaw frozen logs and obtain high quality veneer, mill operators began building conditioning tunnels. Heat was introduced into the tunnels by adding a low quality steam direct from the boiler or it may have been added in the form of hot water. The steam condensate or water was permitted to drain from the conditioning tunnel into nearby waterways such as rivers, streams, ponds or lakes. The dirty water condensate is usually of low pH (acidic) due to the leeching of wood acid from the logs. Also the water contained floating debris such as bark, wood splinters and the like.

Increased awareness of environmental problems, followed by regulations governing discharges into waterways, has made it necessary to change the practice of adding steam and/or hot water to conditioning tunnels without recovery or treatment of the waste water or effluent, commonly referred to as dirty condensate in the industry. The problem has been further magnified by the increasing costs of generating steam without the return of pure steam condensate to the boiler.

Under the old system, the logs were removed from the pond or a field where they were stacked and first debarked. Subsequent to debarking, the peeler logs are cut into two lengths suitable for the lathes in the mill. Generally, logs from a pond or from a dry stack, if peeled without being conditioned result in erratic and low quality peels. The veneer will curl and tear and will develop ragged edges on the sheets. As the industry turned to conditioning tunnels, it was found that conditioned logs resulted in much smoother peeling with fewer tears thus resulting in higher productivity and better quality veneer. The advantages of conditioned logs together with the regulations imposed by local, state and federal government brought about the need for a system which not only conditions but which at the same time does not violate environmental rules, regulations and statutes.

The plywood industry has used various methods for peeler block conditioning, including hot water tubs for soaking, hot water showers, steaming and a combination of steaming with showers. However, none of the prior art conditioning systems has employed a closed system for the conditioning fluids.

SUMMARY OF THE INVENTION

Process for peeler log conditioning in which steam is directed from an established source such as a boiler house to an evaporator which is in effect a combination heat transfer device and vapor head. The steam condensate is returned to the boiler house without having been dirtied or contaminated. Condensate or effluent from the conditioning tunnels is fed to the evaporator where it is heated to steam and recirculated to the conditioning tunnels. Dirty condensate from the conditioning tunnels is led off to a sump area where the condensate is screened. The condensate is then pumped in part to the shower heads in the conditioning tunnel and returned to the evaporator. Essentially the system is closed requiring only a minor amount of makeup water during a given period of operation. The condensate which is generally acidic is raised to a base pH by caustic soda or other basic chemical added to the system.

Accordingly, it is among the many features and advantages of the system to combine steam and water shower conditioning in the steam tunnels to provide high temperatures with moisture for good heat transfer and fiber softening. The system effects saving in steam which has to be generated. The system is entirely closed thus requiring a low volume of water for makeup. The return of dirty condensate either to the shower heads or to the evaporator reduces the requirement for boiler feed water and chemicals and eliminates the necessity of heating fresh water to condensate temperatures. The indirect steam generator in the form of an evaporator uses boiler house steam which condenses on heat transfer surfaces thus preventing its contact with recycled, contaminated and dirty condensate returning from the log conditioning tunnels. The heat so transferred returns the contaminated condensate into steam for reuse in conditioning the logs.

BRIEF DESCRIPTION OF DRAWINGS

FIG. 1 is a diagrammatic representation of a portion of the system showing in a simplified manner the conditioning tunnels and sump area with arrowed lines representing conduits and the like.

DESCRIPTION OF PREFERRED EMBODIMENT

Figure 1:
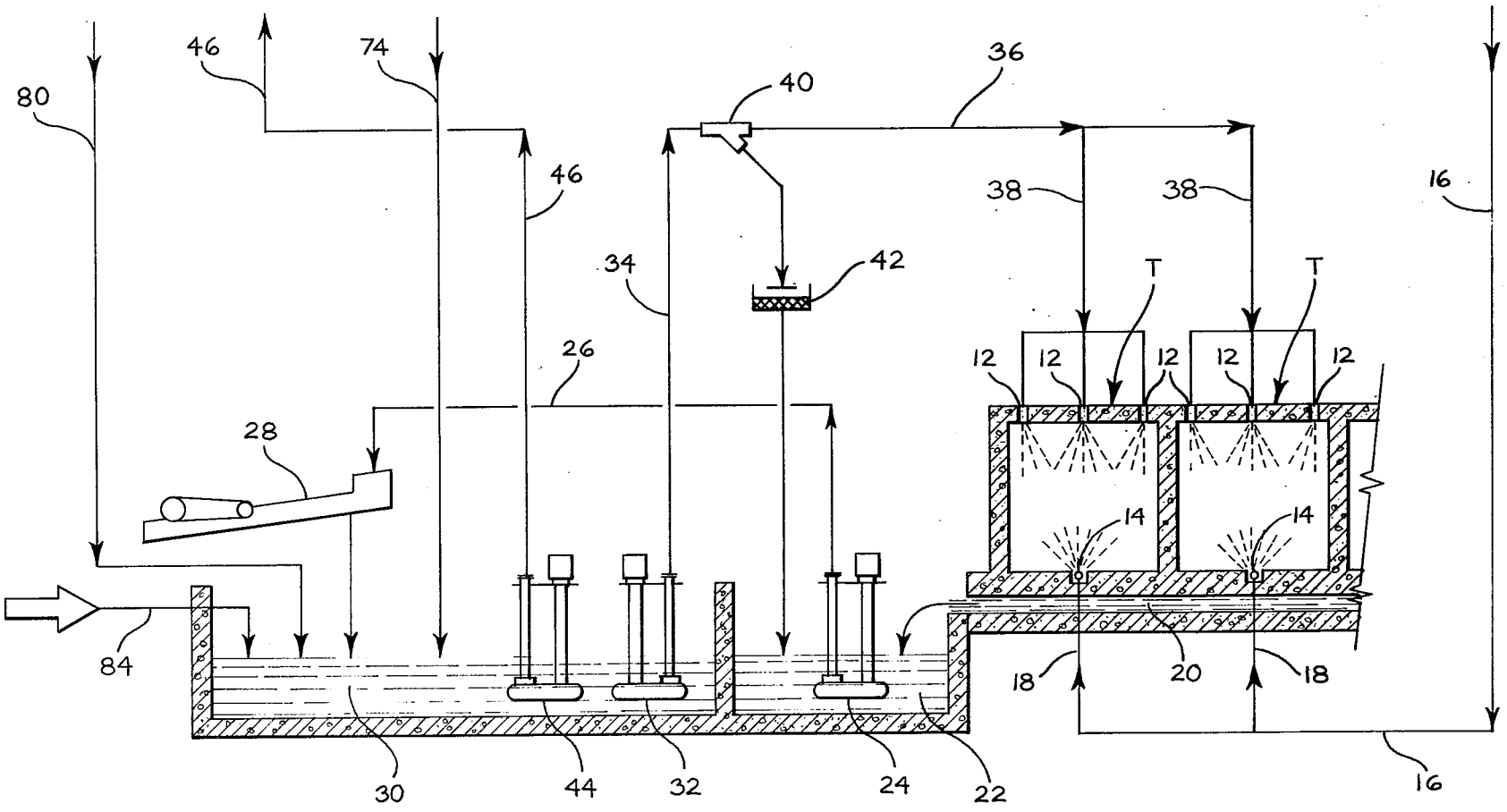

In FIG. 1, it will be seen that the conditioning tunnels T are diagrammatically shown in cross-section for purposes of illustration only. The peeler log conditioning tunnels are about 80 feet long and approximately 18 feet high. Width of the tunnels will vary depending upon the lathes for which the peeler logs are intended and height is determined by the limitations on log handling machines or equipment. The logs are loaded crosswise into the tunnel and stacked to about three quarters of the interior height. The doors of the tunnels are closed and the logs conditioned for a period of from 10 to 24 hours depending on the diameter of the log and the original weather conditions of the log. Ideally, the plant operator will aim for the best peeling temperature, typically 110° to 120° F. at the core of the log.

As can be seen in FIG. 1, showerheads 12 spray water over the logs, with the showerheads being located such that all parts of the log including the ends are exposed to the showers. At the same time, steam lines 14 with nozzles or holes therein are directing steam from the bottom of tunnels T for heating the logs. Thus, it will be appreciated that with the combination of water and steam the logs are conditioned for the lathes. When logs are heated as in a straight steaming operation, they have a tendency to dry out. This is particularly true at the ends of the logs and can result in checking or cracking on the log ends. When the log is peeled for veneer these cracks lead to splitting of the veneer sheet and a loss of grade. In order to reduce checking, steam is mixed with water and showered as a hot water shower downward across the log ends.

The steam itself is introduced to the tunnels via line 16 and branch lines 18 to pipes 14 in which there are nozzles to spray the steam into the tunnel. The steam and heat rise upward around the logs and fill the conditioning tunnel with steam. Condensing steam runs downward by the force of gravity and is continually reheated by rising steam thus maintaining the hottest possible temperature while in contact with the logs. This combination of sprays and steaming is the most efficient method for heating logs short of placing them in a vat of boiling water. It should be noted that there may be only several or as many as 15 or 20 tunnels T in the particular plywood mill. The tunnels T are provided with channels which run the length of the tunnel and which carry the dirty condensate off to a common drain 20 at one end where the dirty condensate is then directed to a first sump area 22. A pump 24 in sump 22 directs the dirty condensate by way of line 26 to a screen 28 for removing floating debris such as bark, wood splinters, and the like. The fluid drops through to a larger second sump 30 with the solids above a certain size having been screened out. A pump 32 via line 34 and header 36 dirty condensate to shower lines 38 for being directed then through branch lines and appropriate piping to the series of nozzles 12 in the tunnels. It will be noted that an in-line strainer 40 and filter 42 may be included between sump 30 and the showerheads 12, if desired. Dirty condensate is also directed by pump 44 through a line 46 to the evaporator, the operation of which will be explained more fully hereinafter. Condensate temperature in sump 30 is maintained at about 160° F.

Figure 2:
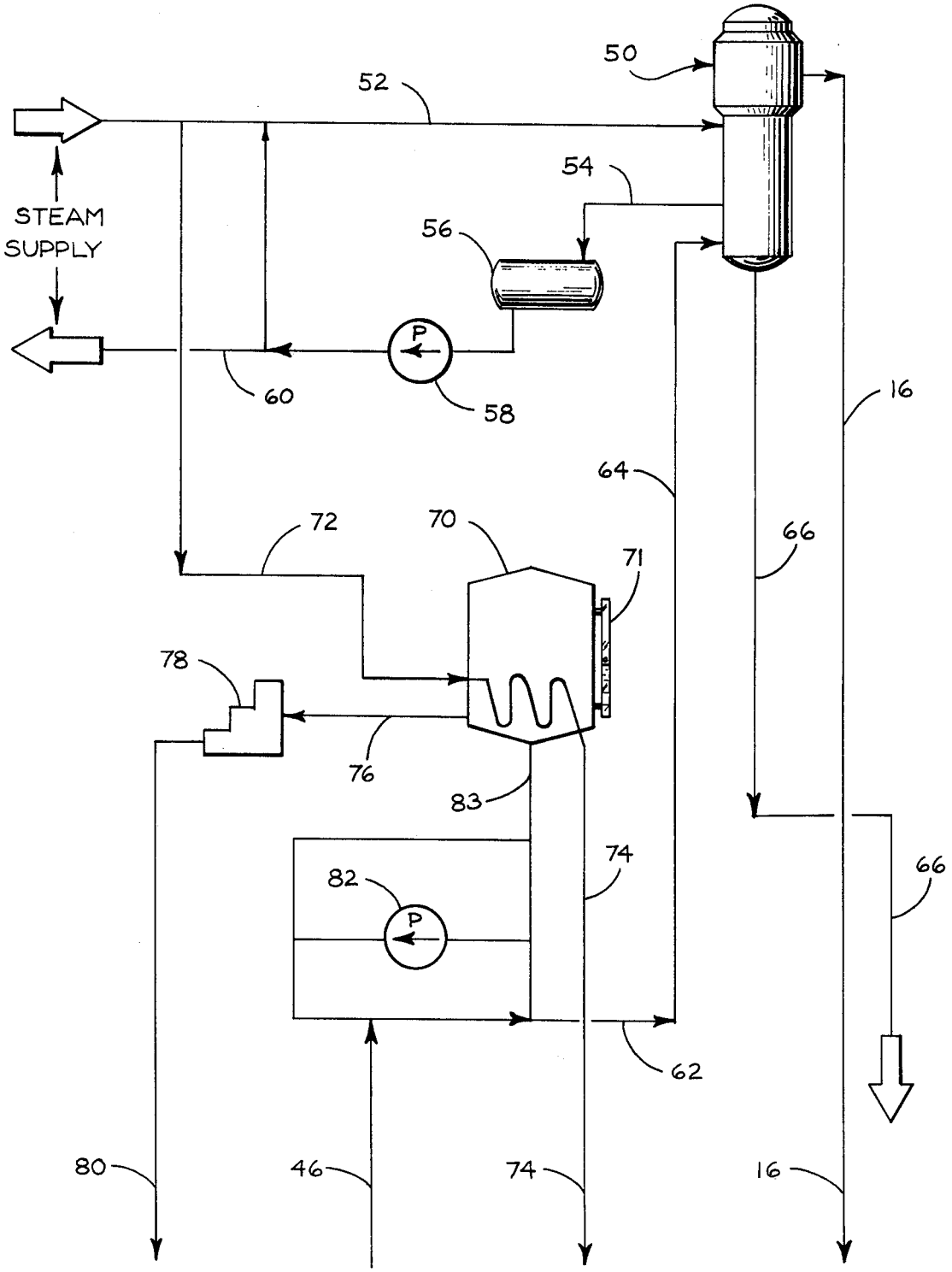
FIG. 2 is a diagrammatic representation of a portion of the system showing the heat exchange and caustic makeup portions of the system.

With respect to FIG. 2, an evaporator 50 includes not only a heat exchanger portion in the lower part thereof, but a vapor head in the upper end. Steam from a source such as a boiler house is directed to the evaporator 50 via line 52 where it is circulated through heat exchange tubes and returned via line 54 to receiver tank 56 and then via pump 58 and line 60 back to the steam supply.

As mentioned above, line 46 from pump 44 in the large sump directs dirty condensate via line 46, line 62 and line 64 to evaporator 50 where the liquid condensate is volatilized into steam in the vapor head at the top of the evaporator and directed via line 16 to the steam pipes and nozzles 14 in the conditioning tunnel. The evaporator 50 is provided with a blow down line 66 where solids such as resin sludge can be removed from the evaporator and blown down to a drum or other container after which the solids can be burned. It will be appreciated that the steam from the steam supply source which comes to the evaporator via line 52 is in a range from 25 to 75 PSIG and at approximately 320° F. The steam is returned as a liquid to steam supply at a lower line pressure but at approximately the same temperature.

A caustic storage tank 70 receives a predetermined amount of steam from line 52 via line 72 into the heating tubes to keep the solution from freezing or solidifying in cold weather. The condensate is then routed via line 74 to the sump tank 30. A fifty percent caustic soda metering pump 78 receives the dilute caustic via line 76 and pumps it to the large sump 30 via line 80. A pH control is important to the system since many of the parts are made of carbon steel. Normally the effluent or dirty condensate in the system is acidic with a pH of about 4 to 5. Thus, caustic is added to increase the pH to a range of about 8 to 10. This pH control prevents a corrosion of the carbon steel parts. Just as important, however, it plasticizes the logs or softens the wood fibers. It may be that the caustic addition also reduces foaming but it is not known for sure that this is the case. Nevertheless, appropriate controls are provided for automatically metering caustic to the sump 30 as it is required.

A pump 82 is shown for unloading a tank truck and pumping the caustic into the storage tank 70. A gauge 71 is provided along side the storage tanks 70 to record the level of the caustic supply. Finally in FIG. 1, it will be seen that makeup water is added to the system by line 84 as required. Appropriate controls and valves are inserted in all lines so that control of the system is virtually automatic at all times.

It will be appreciated that the precise design of the evaporator is not critical to an understanding of the invention, suffice to say that both vertical and horizontal type evaporators could be employed.

What is claimed is:

1. In a closed water and steam conditioning system for peeler log conditioning tunnels including a steam source, the improvements comprising:

(a) an evaporator means having heat exchange and vapor head portions, (b) supply and return lines for connecting said steam source to the heat exchange portion of said evaporator so that steam supplied to said evaporator is returned to said steam source as clean condensate, (c) sump means for receiving dirty condensate from said conditioning tunnels, said sump means including first pump means connected to and for directing dirty condensate to said conditioning tunnels for spraying onto peeler logs in said tunnels, and also having second pump means connected to and for cycling dirty condensate to said evaporator where it is vaporized to steam by heat in said heat exchange portion and directed to the vapor head portion, (d) steam line means in said conditioning tunnels interconnected with the vapor head portion of said evaporator for introducing them into said tunnels, (e) means for directing dirty condensate from said tunnels to said sump means, and (f) chemical storage and pumping means for directing preselected and controlled amounts of chemical to said sump means for maintaining a desired pH reading in said sump means.

2. The closed water and steam conditioning system according to claim 1 and in which first pump means is connected to and directs dirty condensate to means at the top of said conditioning tunnels.

3. The closed water and steam conditioning system according to claim 2 and in which said steam line means are located at the bottom of said conditioning tunnels.

4. The closed water and steam conditioning system according to claim 3 and in which said sump means has a first section in which said first and second pump means are located and a second section which receives said dirty condensate from said conditioning tunnels and in which is located a third pump means for directing dirty condensate to said first section through filter means.

5. The closed water and steam conditioning system according to claim 4 and in which chemical metering and control means are provided for determining the amounts of chemical material to be directed to said sump means.

6. In a closed water and steam conditioning system for peeler log conditioning tunnels including a steam source, the improvements comprising:

(a) an evaporator means having heat exchange and vapor head portions, (b) supply and return lines for connecting said steam source to the heat exchange portion of said evaporator so that steam supplied to said evaporator is returned to said steam source as clean condensate, (c) sump means for receiving dirty condensate from said conditioning tunnels, said sump means including first pump means connected to and for directing dirty condensate to the top of said conditioning tunnels for spraying onto peeler logs in said tunnels, and also having second pump means connected to and for cycling dirty condensate to said evaporator where it is vaporized to steam by heat in said heat exchange portion and directed to the vapor head portion, (d) steam line means in the bottom of said conditioning tunnels interconnected with the vapor head portion of said evaporator for introducing them into said tunnels, (e) means for directing dirty condensate from said tunnels to said sump means, and (f) chemical storage and pumping means for directing preselected and controlled amounts of chemical to said sump means for maintaining a desired pH reading in said sump means.

7. The closed water and steam conditioning system according to claim 6 and in which said sump means has a first section in which said first and second pump means are located and a second section which receives said dirty condensate from said conditioning tunnels and in which is located a third pump means for directing dirty condensate to said first section through filter means.

8. The closed water and steam conditioning system according to claim 7 and in which chemical metering and control means are provided for determining the amounts of chemical material to be directed to said sump means.

* * * * *